United States Patent [19]

Klippstein et al.

[11] 4,320,582

[45] Mar. 23, 1982

[54] YANKEE DRYER AND METHOD OF FABRICATION

[75] Inventors: Karl H. Klippstein; Joseph Sawdai; Charles A. Schacht, all of Pittsburgh; Charles G. Schilling, Murrysville, all of Pa.

[73] Assignee: United States Steel Corporation, Pittsburgh, Pa.

[21] Appl. No.: 144,156

[22] Filed: Apr. 28, 1980

Related U.S. Application Data

[63] Continuation-in-part of Ser. No. 18,963, Mar. 9, 1979, abandoned, which is a continuation-in-part of Ser. No. 794,291, May 5, 1977, abandoned.

[51] Int. Cl.[3] ..... F26B 25/16

[52] U.S. Cl. ..... 34/39; 34/108; 34/110; 29/416; 29/455 R; 165/89; 228/184

[58] Field of Search ..... 29/416, 157 R, 455 R; 228/184; 34/108, 110, 119, 124, 125, 39; 165/89, 90

[56] References Cited

U.S. PATENT DOCUMENTS

| | | | |
|---|---|---|---|
| 3,061,944 | 11/1962 | Kraus et al. | 34/110 |
| 3,118,743 | 1/1964 | Malmstrom et al. | 34/110 |
| 3,911,595 | 10/1975 | Lande | 34/110 |
| 4,235,361 | 11/1980 | Hays et al. | 29/446 |

*Primary Examiner*—Larry I. Schwartz
*Attorney, Agent, or Firm*—William F. Riesmeyer

[57] ABSTRACT

A Yankee Dryer used in drying a web of paper or like materials in which all structural components are fabricated of weldments of steel plate and forgings and in which the outer shell is formed of a weldment of steel plates expanded to roundness and machined to final dimensions. All primary welds are subject to X-ray inspection. The dryer is of lighter weight than the usual cast iron Yankee Dryers, yet designed to withstand substantially higher steam pressure within the shell.

4 Claims, 7 Drawing Figures

Condensate Out
Steam In
10
12
13
14
15
16
17
18
19
20
21
22
23
24
27
28
29
30
30a $Di/Do = 0.48$ $Di/Do = 7/12 = 0.58$ $Di/Do = 5/12 = 0.42$

YANKEE DRYER AND METHOD OF FABRICATION

This application is a continuation-in-part of our earlier application, Ser. No. 018,963 filed Mar. 9, 1979 now abandoned which in turn is a continuation-in-part of our application Ser. No. 794,291 filed May 5, 1977 now abandoned.

This invention relates to an improved dryer of the type commonly known as a "Yankee Dryer" used in the manufacture of paper and like materials, and to an improved method of fabricating a dryer.

A conventional Yankee Dryer includes a large cast iron cylindrical outer shell, typically about 8 to 15 feet in length, 10 to 20 feet in diameter and weighing over 100 tons. Steam, usually under a pressure of about 120 to 150 psig, is introduced to the interior of the shell and heats the inner surface to a temperature up to about 350° F. The cast iron of the shell has allowable stress, according to recognized Engineering Standards, of only about 8,000 psi; hence the wall is made two to three inches thick to withstand the pressure. The outside surface of the shell has a mirror-like finish. The shell is supported for rotation on a horizontal axis so that a web of paper or the like can travel around about three quarters of the circumference for drying under heat. Typical speeds of rotation are 70 to 100 rpm.

Conventional Yankee Dryers have a number of disadvantages. The internal pressure must be limited to a maximum of about 150 psig. As a result, the internal temperature, drying capacity, and operating speed are also limited. The combined effects of corrosion and wear make it necessary to regrind the cast iron shell at frequent intervals and eventually to replace the shell when the thickness is excessively reduced. The exceedingly heavy dryer rotates at relatively high speed and hence requires considerable power to operate and for acceleration and deceleration forces. Massive foundations are needed to withstand operational forces. The dryer is made up of several pieces, each of intricate shape and close dimensional tolerances.

Efforts have been made to construct the outer shell of the dryer of lighter materials, such as a weldment of steel plates. Reference can be made to Charlton et al U.S. Pat. No. 2,697,284 or Kraus U.S. Pat. No. 3,116,985 for examples of showings of dryers thus constructed. Such dryers have not been notably successful, and most Yankee Dryers continue to be constructed of cast iron.

An object of our invention is to provide an improved Yankee Dryer in which the outer shell is constructed of a weldment of relatively light weight steel plates, but which overcomes difficulties encountered previously and permits higher operating speed.

A further object is to provide an improved method of fabricating a Yankee Dryer in which we form the outer shell of welded steel plates expanded into roundness and machined to final dimensions.

A further object is to provide an improved Yankee Dryer, which has flat steel heads and an outer shell formed of welded steel plates, and forged rings bolted to said heads, said outer shell being expanded into roundness.

A further object is to provide an improved Yankee Dryer in which the outer shell, inner shell and heads each are formed as weldments of relatively light weight steel plates but can withstand internal pressures as high as 350 to 450 psig and thereby permits higher internal temperatures, drying capacities and operating speeds.

A further object is to provide an improved Yankee Dryer that utilizes an optimum outer-shell thickness to obtain the maximum possible drying capacity and operating speed.

A further object is to provide a more flexible outer shell which improves the control of the nip roll pressure within more accurate limits.

A further object is to provide an outer cylindrical shell with an increased usable width providing increasing production.

A further object is to provide an improved Yankee Dryer that has a unique relationship between the diameter of an outer shell and inner shell, or between the diameter of an outer shell and a circular cylindrical plane defined by the locus of spaced stays where they are used in place of an inner shell, in order to minimize the thickness and weight of the heads.

A further object is to provide an improved Yankee Dryer that has considerably greater resistance to corrosion and wear than conventional dryers.

A further object is to provide an improved Yankee Dryer that is of lighter weight, faster drying and can also fit the same installation and foundation of existing Yankee Dryers.

Figures 1, 2, 3:
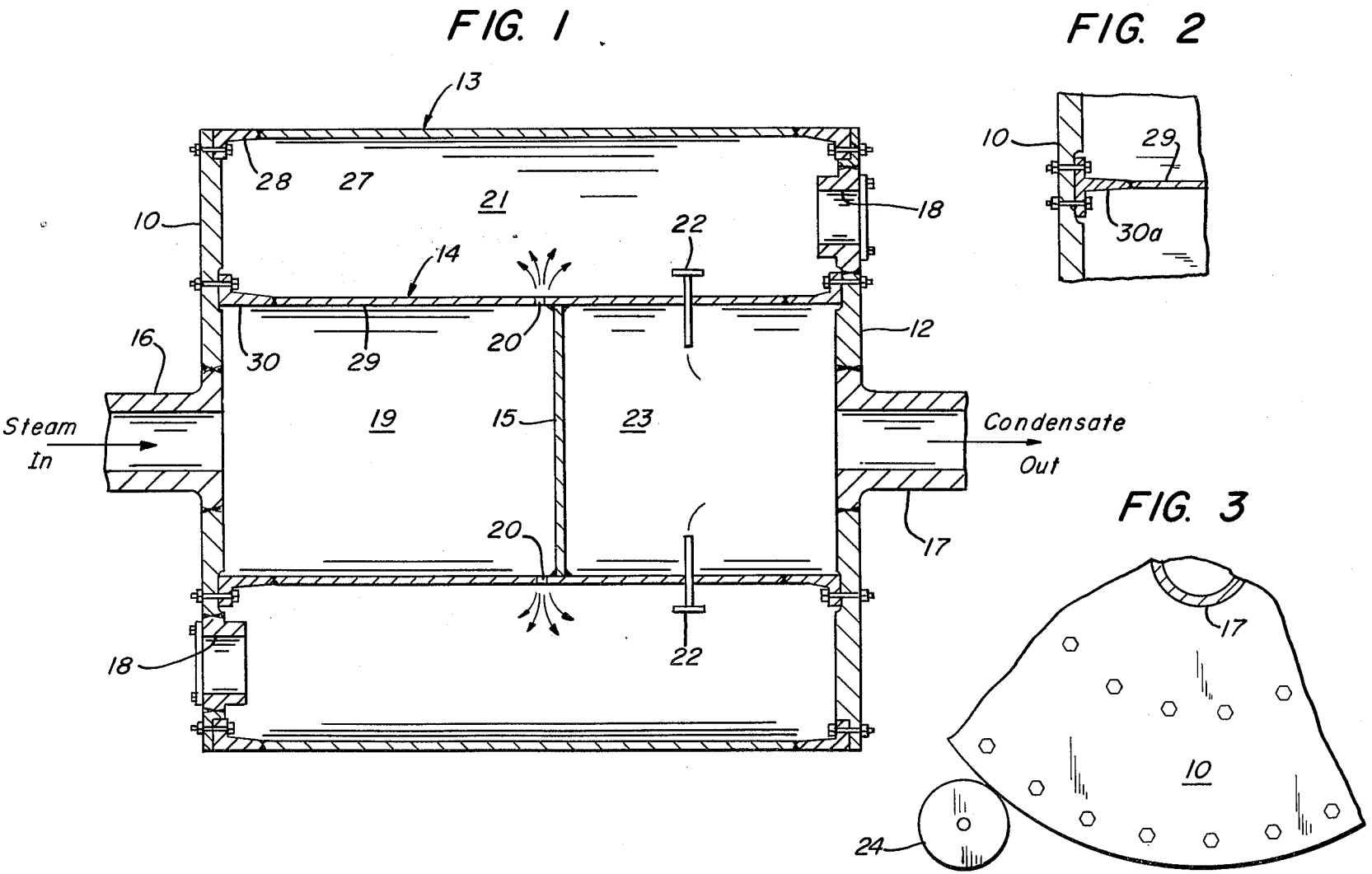
FIG. 1 is a vertical longitudinal sectional view of a Yankee Dryer constructed in accordance with our invention.
FIG. 2 is a fragmentary vertical sectional view showing a modified detail.
FIG. 3 is a fragmentary diagrammatic end elevational view of the dryer.

The dryer of our invention comprises a pair of opposed heads 10 and 12, spaced apart with outer and inner shells 13 and 14, a transverse partition 15 within the inner shell, and tubular journals or trunnions 16 and 17 extending from the heads 10 and 12 respectively. As will be described hereafter stays may be used in place of the inner shell. The heads preferably are flat and have the usual manholes 18. High pressure steam is introduced to the interior of the outer shell to provide heat. In the dryer illustrated, steam is introduced through trunnion 16 to a compartment 19 in the inner shell 14 at the left of the partition 15 and passes through ports 20 in the inner shell into an annular chamber 21 between shells. The condensate is collected in a suitable condensate collector 22, shown only diagrammatically, returns to a compartment 23 within the inner shell 14 at the right of the partition 15, and discharges through the trunnion 17. Many ways of supplying steam and collecting condensate are known to those familiar with the Yankee Dryers. Any such method can be adapted to this invention and the above-described scheme is only one such method to be illustrated.

As is conventional, the dryer rotates on a horizontal axis while a web of paper or like material passes around approximately three quarters of the circumference of the outer shell 13 for drying. The web may be pressed on the shell by the usual nip roller 24 shown diagrammatically in FIG. 3, and removed by the usual doctor blade (not shown). Reference can be made to the aforementioned Kraus patent for exemplary showings of suitable condensate collectors, nip roller, and doctor blade.

In accordance with our invention, we form the outer shell 13 of steel plates 27 butt-welded to form a cylindrical weldment, and rings 28, preferably forged steel, butt-welded to the weldment at its ends. The plates have a uniform thickness of about 1 to 2 inches, determined as hereinafter explained. The weld metal is of a hardness approximately equal to the hardness of the steel of the plates. Thus in dryers that are not spray coated, as hereinafter described, wear which results from the doctor blades scraping against the shell is uniform, and there are no "bumps" as welds pass the doctor blade. Also the weld metal is of a composition which has thermal conductivity approximately equal to that of the weld area and of the steel plates. Thus paper drying will be uniform across the face of the dryer.

In forming the outer shell 13, we first weld the plates 27 to form a roughly cylindrical weldment a little smaller than the finished shell. Next we expand the weldment by 0.5 to 1.0 percent of its diameter to round the ends for easier fit-up. Then we weld the rings 28 to the weldment of steel plates to form the completed weldment. We subject the welds to a first X-ray inspection at this stage. Next we stress relieve the weldment and then expand the weldment to approximately its final dimensions and to proper roundness. The total expansion is sufficient to increase the shell diameter 1 to 1½ percent, and has the added benefit of cold-working the weldment. Next we machine the weldment to its final dimensions within close tolerances. Since we have already expanded the weldment to roundness, the thickness of metal removed in the machining operation is minimal and is nearly uniform around the circumference of the weldment. This fact not only results in a more economical machining operation, but also eliminates problems with plate grain rolling pattern. Apparatus for expanding cylindrical shapes is known; hence we have not included an illustration. Suitable apparatus is available commercially from Grotnes Machine Works, Inc. Chicago, Illinois, and is shown in their brochure entitled "#40H-1580 Expander" or in Cvijanovic U.S. Pat. No. 3,583,200.

Figure 4:
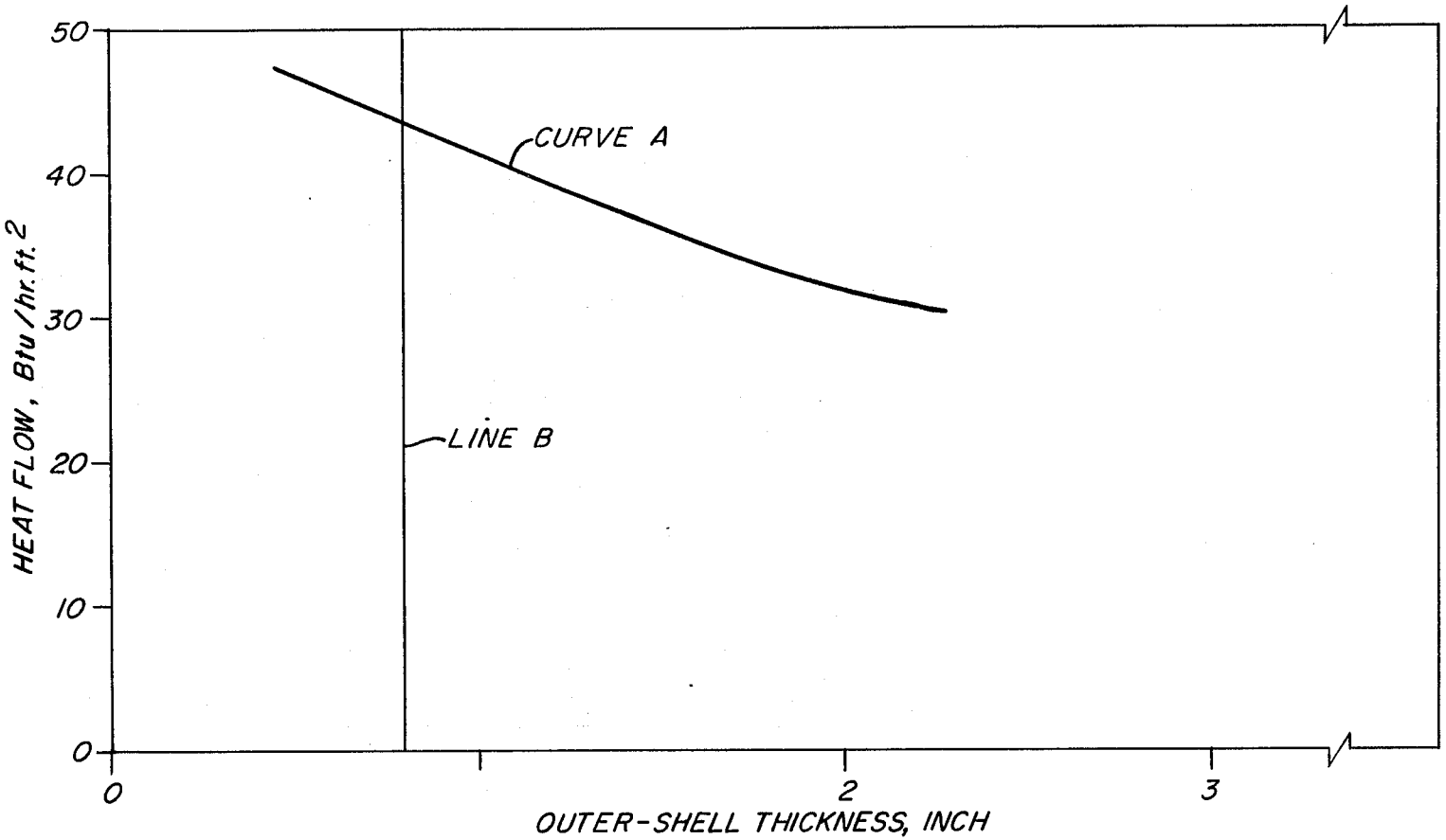
FIG. 4 is a graph showing the way in which we determine the wall thickness of the outer shell.

In designing the dryer, we select an optimum outer-shell thickness to obtain the maximum possible drying capacity and operating speed. There are an infinite number of different combinations of outer-shell thickness and operating pressure that could be used in an attempt to obtain the maximum possible drying capacity. It is not obvious which of these combinations would provide the maximum drying capacity, since a change in thickness has two opposing effects on the heat flow through the shell and the corresponding drying capacity. First, an increase in thickness tends to decrease the heat flow by increasing the thickness of metal through which the heat must pass. Second, an increase in thickness tends to increase the heat flow by permitting a higher internal pressure and corresponding temperature. In cast iron dryers typical of present practice, the thickness is almost always selected to permit the use of an internal pressure of 150 psi—a pressure just below the maximum permitted for cast iron (except under special conditions) by the ASME Boiler and Pressure Vessel Code. This procedure results in the use of the maximum thickness that can be effectively utilized within Code limitations. In contrast, we discovered that for steel dryers the net effect of an increase in thickness is a decrease in heat flow as illustrated by curve A in FIG. 4, which specifically applies to a 15-foot-diameter dryer of steel with an allowable stress of 21000 psi. Consequently, the optimum outer-shell thickness for our steel design is the smallest thickness that will safely withstand the nip roller fatigue loading. This thickness is represented by Line B in FIG. 4. Thus, our design utilizes the smallest permissible thickness in contrast to cast iron designs typical of present practice which utilize the largest permissible thickness.

Likewise we form the inner shell 14 of steel plates 29 butt-welded to form a cylindrical weldment and rings 30 preferably of forged steel butt-welded to the plates at the ends of the weldment. The plates of the inner shell can be thinner, typically ¾to 1 inch thick. We weld the partition 15 within the inner shell. The rings 28 and 30 have flanges which we bolt to the heads 10 and 12 to hold the parts in assembled relation. The main purpose of the inner shell is to tie or connect the heads, and it is possible to use alternate connecting means, such as stays. The stays may be a plurality of rods or bolts equally spaced and extending longitudinally parallel to the axis of the outer shell. The locus of the longitudinal axes of the stays define a circular cylindrical plane concentric to the outer shell. All welds, except for those fixing the partition 15 in the inner shell 14, are butt welds readily subject to X-ray inspection. We may form the inner shell by the procedure already described for forming the outer shell, although less precision is needed, and it may not be necessary to expand.

Figure 7:
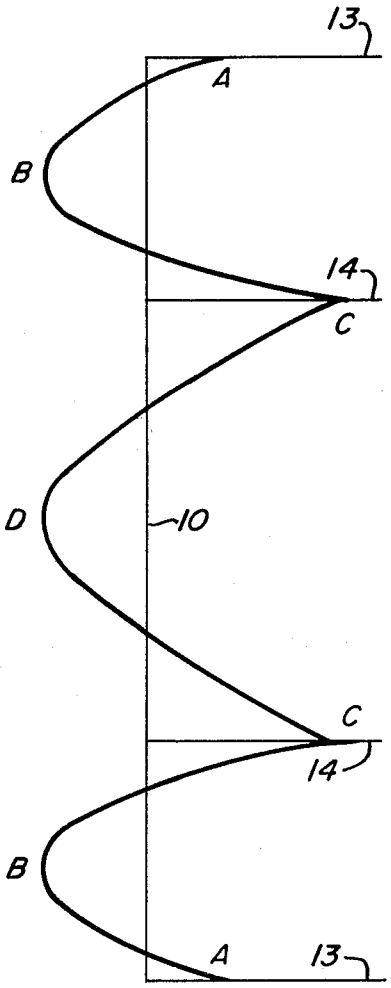
FIGS. 5, 6 and 7 are diagrammatic vertical sectional views of the outer and inner shells and one head illustrating the relation between the ratio of shell diameters and the radial bending stress in the head, the local effects of the trunnions being neglected.
Figure 6:
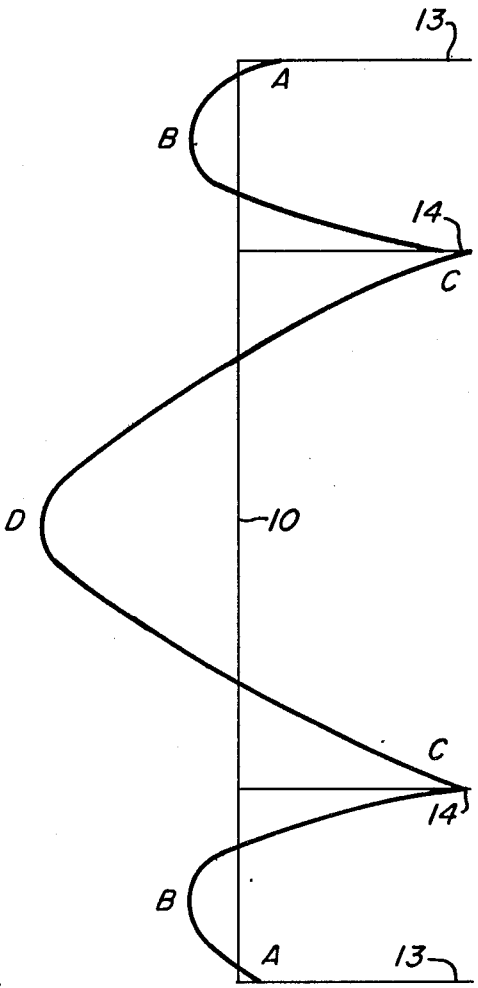
Figure 5:
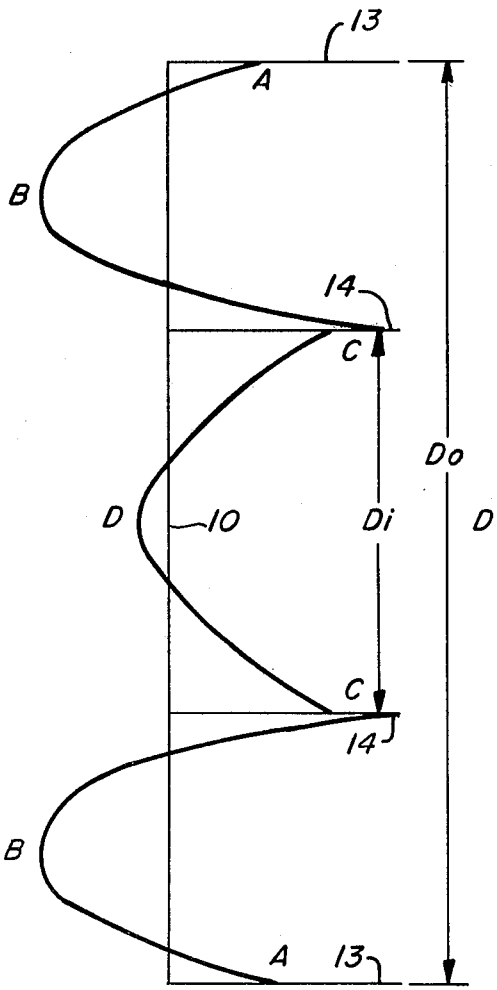

We fabricate the flat heads 10 and 12 of plate steel. We butt-weld the trunnions 16 and 17 and rings forming the manholes 18 to the heads. Thus each head is in effect integral with its respective trunnion and we avoid need for bolted joints adjacent the trunnions where high stresses occur. The trunnions and manhole rings preferably are forgings. We subject the trunnion welds to X-ray inspection and then stress-relieve the weldments of heads and trunnions and machine the heads to final dimensions. The ratio of inner shell diameter or diameter of a cylindrical plane defined by the locus of spaced stays where used, to outer shell diameter should be approximately between 0.45 and 0.50, with an optimum of 0.48, to enable heads of minimum thickness and weight to be used. All references to diameter in the specification and claims shall mean the diameter as measured from mid-points of the thickness of that particular part, eg. outer or inner shells, and also mid-point of stays where used in place of an inner shell. FIGS. 5, 6 and 7 illustrate diagrammatically the way in which radial bending stresses in the heads are affected by the ratio of the shell diameters. In each instance the curves to the left of the head represent positive radial bending stresses (i.e. tension in the outside face of the head, compression in the inside face), while the curves to the right of the head represent negative radial bending stresses (i.e. compression in the outside face, tension in the inside face). Peak positive stresses occur at locations B and D, peak negative stresses at locations A and C.

A head of uniform thickness must be designed to withstand the larger of the two peak positive bending stresses. Peak negative stresses do not govern head design, since recognized design specifications, such as the ASME Boiler and Pressure Vessel Code, permit considerably higher bending stresses at locations A and C than at locations B and D.

FIG. 5 shows relative bending stresses in the head of a cylinder in which the ratio of the inner shell diameter $D_i$ to the outer shell diameter $D_o$ is about 0.42. The positive bending stress at B is substantially greater than that at D. FIG. 6 shows the relative bending stresses in the head of a cylinder in which the ratio is about 0.58. The positive bending stress at D has become substantially greater than that at B. FIG. 7 shows the relation with the optimum ratio of about 0.48. The positive bending stresses at B and D are equal and are substantially less than the higher of two peaks in either FIG. 5 or 6. The higher of the two peaks always increases as the diameter ratio departs in either direction from the optimum. Thus use of the optimum diameter ratio provides a balanced design and makes possible the use of a head of minimum uniform thickness. A further advantage of using the optimum diameter ratio is that bending stresses in the inner shell caused by rigidly connecting it to the head are relatively low.

Optionally we may apply a coating of hard material, such as stainless steel, to the outer shell. If the outer shell is coated, we apply the coating after the dryer is fully assembled. The outer shell may be coated, for example, by spraying. The coating has a thickness of about 0.1 inch and is ground to a mirror-like finish. The coating offers an advantage of affording better resistance to corrosion and wear.

FIG. 2 shows a modified construction of ring 30a for attaching the weldment 29 of the inner shell to the head 10. The ring 30a is of T-shape in cross section. This facilitates bolting, and reduces connection eccentricity.

From the foregoing description it is seen that our invention affords a Yankee Dryer of relatively light weight, yet capable of withstanding higher pressures than conventional dryers. The dryer is of simple construction, and the outer shell is of uniform wall thickness obtained by expanding the weldment to roundness before machining to final dimensions. The invention also affords a simple effective method of fabricating the dryer.

We claim:

1. A method of fabricating a Yankee Dryer which has a pair of trunnions, an outer shell, heads attached to said shell and trunnions and connecting means for tying said heads together, said method comprising:

forming a roughly cylindrical weldment of steel plates butt-welded together and being of slightly smaller diameter than the desired final diameter of said outer shell;

expanding said weldment by about 0.5 to 1.0 percent of its diameter to provide roundness;

welding rings to the ends of said weldment;

stress-relieving said weldment;

re-expanding said weldment to provide a total expansion of 1.0 to 1.5 percent of its diameter and bring the weldment close to the final dimensions of said outer shell;

machining said weldment to the final dimensions of said outer shell; and assembling said outer shell heads and connecting means.

2. A method as defined in claim 1 comprising in addition subjecting the welds in said outer shell to X-ray inspection.

3. A method as defined in claim 1 further comprising forming a cylindrical weldment of steel plates butt-welded together to make an inner shell for serving as said connecting means.

4. A method as defined in claim 3 further comprising forming said heads of flat steel plates of uniform thickness, welding said heads to said trunnions, and subjecting the welds in said outer shell, inner shell and heads to X-ray inspection.

* * * * *